US007771193B2

(12) United States Patent
Katsumata

(10) Patent No.: US 7,771,193 B2
(45) Date of Patent: Aug. 10, 2010

(54) DOUBLE-CHAMBER TYPE HEAT-TREATING FURNACE

(75) Inventor: Kazuhiko Katsumata, Tokyo (JP)

(73) Assignee: IHI Corporation, Tokyo (JP)

( * ) Notice: Subject to any disclaimer, the term of this patent is extended or adjusted under 35 U.S.C. 154(b) by 440 days.

(21) Appl. No.: 10/599,034

(22) PCT Filed: Mar. 18, 2004

(86) PCT No.: PCT/JP2004/003669

§ 371 (c)(1),
(2), (4) Date: Sep. 18, 2006

(87) PCT Pub. No.: WO2005/090616

PCT Pub. Date: Sep. 29, 2005

(65) Prior Publication Data

US 2007/0172786 A1 Jul. 26, 2007

(51) Int. Cl.
*F27B 9/02* (2006.01)

(52) U.S. Cl. ..... 432/128; 432/205; 266/250

(58) Field of Classification Search ..... 432/121, 432/128, 205, 207; 266/250, 258, 277, 252
See application file for complete search history.

(56) References Cited

U.S. PATENT DOCUMENTS 2,731,127 A * 1/1956 Harrison ..... 198/468.6
4,518,353 A * 5/1985 Banno et al. ..... 432/205
4,560,348 A 12/1985 Moller et al.
4,610,435 A 9/1986 Pfau et al.
4,836,776 A 6/1989 Jomain
4,854,863 A 8/1989 Hemsath
4,932,864 A 6/1990 Miyabe
4,963,091 A 10/1990 Hoetzl et al.
5,035,610 A 7/1991 Hoetzl et al.
5,052,923 A * 10/1991 Peter et al. ..... 432/205
5,290,189 A 3/1994 Hemsath et al.
5,443,383 A 8/1995 Kuehn
6,530,780 B2 * 3/2003 Mori et al. ..... 432/121
6,821,114 B2 11/2004 Kisoda
7,090,488 B2 * 8/2006 Murakami et al. ..... 432/128

(Continued)

FOREIGN PATENT DOCUMENTS

CN 1426484 A 6/2003

(Continued)

OTHER PUBLICATIONS

Yamazaki, Katsuhiro, "Vacuum Heat Treatment," Heat Treatment, 1990, pp. 110-115, vol. 30, No. 2.

(Continued)

*Primary Examiner*—Gregory A Wilson
(74) *Attorney, Agent, or Firm*—Griffin & Szipl, P.C.

(57) ABSTRACT

A double-chamber type heat-treating furnace comprises a hermetically closable cooling furnace, a hermetically closable heating furnace, and a transfer unit. The transfer unit has free rollers disposed within the heating and cooling chambers and for supporting the object at only both ends in a direction of width thereof, a push-pull member moving while being engaged with the object to push or pull the object, and a drive unit provided at a position adjacent to the heating chamber on a side opposite to a side on which the cooling chamber is disposed and driving the push-pull device.

8 Claims, 5 Drawing Sheets

U.S. PATENT DOCUMENTS

| | | | |
|---|---|---|---|
| 2007/0172786 | A1 | 7/2007 | Katsumata |
| 2007/0212657 | A1 | 9/2007 | Katsumata et al. |

FOREIGN PATENT DOCUMENTS

| | | | |
|---|---|---|---|
| DE | 3215509 | A1 | 10/1983 |
| EP | 0422353 | A2 | 4/1991 |
| EP | 1475446 | A1 | 11/2001 |
| EP | 1643199 | A1 | 4/2006 |
| EP | 1801529 | A1 | 6/2007 |
| GB | 2117880 | A | 10/1983 |
| JP | 61-15079 | A | 1/1986 |
| JP | 01-176023 | A | 7/1989 |
| JP | 5-001887 | A | 1/1993 |
| JP | 05-230528 | | 9/1993 |
| JP | 8-295926 | | 11/1996 |
| JP | 2731127 | | 11/1996 |
| JP | 08-327240 | | 12/1996 |
| JP | 11-153386 | A | 6/1999 |
| JP | 2002333277 | | 11/2002 |

OTHER PUBLICATIONS

International Search Report issued in corresponding application No. PCT/JP2004/003669, completed May 10, 2004 and mailed May 25, 2004.

Supplementary European Search Report issued in corresponding application No. EP 04721644, completed Jul. 3, 2008 and mailed Jul. 15, 2008.

* cited by examiner

DOUBLE-CHAMBER TYPE HEAT-TREATING FURNACE

This is a National Phase Application in the United States of International Patent Application No. PCT/JP2004/003669 filed Mar. 18, 2004. The entire disclosure of the above patent application is hereby incorporated by reference.

BACKGROUND OF THE INVENTION

1. Technical Field

The present invention relates to a vacuum type heat-treating furnace, and more particularly, to a double-chamber type heat-treating furnace.

2. Description of the Related Art

A vacuum type heat-treating furnace is a heat-treating furnace in which heat treatment is applied to an object to be treated (hereinafter referred to as an object) after re-filling of inert gas therein subsequent to a reduction in its internal pressure. In the vacuum type heat-treating furnace, when moisture is attached to the inside of the furnace and the object after heating the furnace per se, and when the moisture is gasified, since the furnace can be again depressurized to subsequently accomplish re-filling of the inert gas thereby completely removing moisture component from the furnace, there is such a merit that heat treatment with no coloring by moisture (it will hereinafter be referred to as "bright heat treatment") can be effected.

Further, a gas-cooling type vacuum heat-treating furnace can carries out bright heat treatment and also, can enjoy various advantages such as no occurrence of decarburizing or carburizing, a less deformation, and acquirement of improved working environment. However, the gas-cooling type vacuum heat-treating furnace during the initial stage employs pressure-reduction cooling system. Thus, it must be encountered by such a defect that cooling speed is insufficient. Therefore, to increase the cooling speed, a high-speed-circulation type gas-cooling system has come into practical use.

FIG. 1 is a general configuration of a high-speed-circulation gas-cooling furnace as disclosed in non-patent publication 1. In this drawing, reference numeral 50 designates heat-insulating material, 51 a heater, 52 an effective working area, 53 a furnace body and a water-cooling jacket, 54 a heat-exchanging device, 55 a turbo fan, 56 a fan-motor, 57 a cooling door, 58 a furnace floor, and 59 a gas-distributor.

Further, the patent document 1 discloses "a method of promoting gas-circulation cooling in a vacuumed furnace". In the vacuumed furnace, as illustrated in FIG. 2, heating chamber 66 surrounded by heat-insulating walls 67 is provided within hermetically sealed vacuum container 61, so that heater 62 disposed in the heating chamber heats heated object 64 in vacuum environment. In addition, cooler 62 and fan 63 are disposed in the vacuum container 61, so that non-oxidizing gas supplied into the vacuum container is cooled by cooler 62 and is introduced, due to the rotation of fan 63, into heating chamber 66 through openings 68 and 69 provided in respective faces of opposing heat-insulating walls 67 to be circulated within the heating chamber 66 so as to forcibly applying gas-cooling by circulation to the heated object 64. In the described vacuumed furnace, heat-resistant cylindrically-shaped hood 65 having at least one end formed in a divergent shape is disposed so as to surround the circumference of heated object 64, which is positioned within heating chamber 66, with an appropriate space therebetween, and the opposite ends of the hood are arranged to oppose to the above-mentioned openings 68 and 69 so that the non-oxidizing gas is circulated within heating chamber 66.

On the other hand, the patent document 2 is known which discloses a double-chamber type heat-treating furnace in which heating and cooling are carried out in separate zones.

The "multi-chamber type heat-treating furnace" of the patent document 2, which is, as illustrated in FIG. 3, formed with a gas-cooling chamber and a heating chamber sectioned by an intermediate door, is provided with, at openings 72*a* and 72*b* disposed on opposite sides of gas-cooling chamber 71 for passing therethrough a material to be treated, clutch-system hermetically closable door 73 and 74, thereby forming the gas-cooling chamber in a pressure-resistant structure. In addition, at least clutch-system hermetically closable door 74 on the side of heating chamber 75 is structured to have an elevating system, and heat-insulating door 78 is disposed at the material-passing opening of the heating chamber so that heat-insulating door 78 and clutch-system hermetically closable door 74 on the side of the heating chamber are arranged within door-hood 79, which is provided between heating chamber 75 and gas-cooling chamber 71.

[Non-patent Document 1]

Heat Treatment volume 30, No.2, Vacuum Heat Treatment of Metallic Materials (2) written by Katsuhiro YAMAZAKI, April, H2 (1990)

[Patent Document 1]

Japanese Unexamined Patent Publication No. H5-230528

[Patent Document 2]

Japanese Patent Publication No. 2731127

The high-speed circulation-gas cooling furnace disclosed by the non-patent document 1 and the patent document 1 is constructed so that heating and cooling operations are performed in the same zone and therefore, there have been problems as follows.

(1) The heater for heating-purpose and the furnace body are at a high temperature condition at completion of heating operation and accordingly, the heater and the furnace body must be cooled simultaneously at the time of cooling operation. Thus, rapid cooling of the object to be treated cannot be achieved.

(2) The heater for heating purpose and the furnace body are arranged so as to surround the object to be treated and therefore, the cooling gas cannot be evenly supplied at the time of cooling operation.

Further, in the double-chamber type heat-treating furnace disclosed by the Patent document 2 heating and cooling operations are performed in the separate zones and therefore, the problems (1) and (2), above can be eliminated. However, there is still a problem as follows.

(3) In the double-chamber vacuum heat-treating furnace, a transfer mechanism for transferring objects to be treated between heating and cooling chambers is indispensable. This transfer mechanism is comprised of a roll-conveyer supporting, for example, the lower face of the object to be treated, and horizontally moving same.

Nevertheless, when this mechanism is disposed under the objects to be treated within the cooling chamber, smooth flow of the gas within the cooling chamber is hindered to render the flow of the gas complicated and accordingly, the cooling gas cannot be evenly supplied to the objects to be treated.

Moreover, even when the transfer mechanisms are arranged on respective sides of the heating/cooling chambers, drive rollers act to form a partial block, for example, over a width of the chambers in direction and therefore, the cooling gas cannot be equally supplied upwardly and downwardly to the objects to be treated. Further, if a drive mechanism is disposed in the heating chamber, protections against heat to the drive mechanism is indispensable, and as a result, the drive mechanism must become complicated.

SUMMARY OF THE INVENTION

The present invention is contrived to solve the above-described problems. Namely, an object of the present invention is to provide a double-chamber type heat-treating furnace which is capable of transferring an object to be treated (hereinafter referred to as "object") between a heating chamber and a cooling chamber, being quite rare in forming block against the lower face of the object in the cooling chamber thereby not preventing a smooth flow of a cooling gas within the cooling chamber, equally supplying the cooling gas upwardly and downwardly to the object, being substantially unnecessary to take any measures against heat of a drive mechanism, and being simple in its structure.

In accordance with the present invention, there is provided a double-chamber type heat-treating furnace, which includes a hermetically closable cooling furnace incorporated therein a cooling chamber for cooling an object after being heated, a hermetically closable heating chamber incorporating therein a heating chamber disposed adjacent to the cooling chamber and arranged for heating the object, and a transferring unit for transferring the object between the heating chamber and cooling chamber, the transferring unit being characterized by comprising a plurality of free rollers installed in the heating and cooling chambers and supporting the object so that only both ends of the object in a direction of width thereof is movable in a transferring direction, a push-pull member arranged to move while being engaged with the object to thereby push and pull the object, and a drive unit arranged adjacent to the heating chamber on a side opposite to a side on which the cooling chamber is arranged and provided for driving the push-pull member.

In accordance with the configuration of the above-mentioned present invention, only the free rollers constituting the transferring unit are disposed within the heating and cooling chambers to thereby support only both ends of the object in the direction of width thereof. Hence, smooth flow of a gas within the cooling chamber is substantially rarely prevented. Further, the free rollers are provided with only a function supporting the object to be movable in a transferring direction, and are rarely required to protect against heat so that they may be simple in the structure thereof.

Accordingly, in the cooling chamber, there is no element of the transferring unit except for the free rollers and thus, a gas flow will not be subjected to blocking. In addition, in the heating chamber, there is no element of the transferring unit except for the free rollers and thus, no complicated means for the transfer of the object is required.

In accordance with a preferred embodiment of the present invention, the above-mentioned push-pull member is provided with an engaging member which is capable of turning up to a high position where it is engaged with the object to apply thereto pushing and pulling operation and of lying down to a low position where it is not engaged with the object thereby for being permitted to horizontally move.

Due to this configuration, by permitting the engaging member to turn up to the high position, and by moving the push-pull member in a horizontal direction, it is possible to horizontally push and pull the object. Also, by permitting the engaging member to lie down to the lower position, it is possible to horizontally move the push-pull member without engaging of the engaging member with the object.

Further, the above-mentioned drive unit is preferably comprised of a horizontally movable chain that is connected to a rearmost end of the push-pull member and horizontally move, a sprocket engaged with the horizontally movable chain, and a rotation-drive motor for rotationally drive the sprocket.

Due to this configuration, by rotating the sprocket by the rotation-drive motor so as to horizontally move the horizontally movable chain, it is possible to horizontally move the push-pull member to thereby horizontally move the engaging member disposed at a front end of the push-pull member.

Also, in accordance with another preferred embodiment of the present invention, the cooling furnace is provided with a carrying-in/out door for cooling chamber, which is disposed on a side opposite to the side on which the heating chamber is provided and is arranged for performing carrying the object into or out of the cooling chamber, and a gas-cooling/circulating unit for cooling chamber, which is able to cool a gas vertically passing through an inside of the cooling chamber, the cooling chamber is provided for surrounding a cooling region in which the object is permitted to be steadily placed and defining, in an inside of the cooling region, and having a gas passageway with a constant cross-section in a vertical direction.

Due to this configuration, the object may be carried into or out of the cooling chamber by means of the carrying-in/out door for cooling chamber. Further, by circulating the cooling gas vertically around the object steadily mounted in the cooling region of the cooling chamber by means of the gas-cooling/circulating unit for cooling chamber, it is possible to equally supply the cooling gas upwardly or downwardly to the object.

Also, in accordance with a further preferred embodiment of the present invention, the heating furnace is provided with a vacuum container of which an interior is exhausted to become at vacuum, a heating chamber receiving therein the object, a front door for introducing and delivering the object into and from the heating chamber, a rear door for closing an opening provided for permitting, therethrough, the object within the heating chamber to be moved, a mounting bed for mounting thereon the object to be horizontally movable back and forth, and a heater arranged for heating the object.

Due to this configuration, the interior of the vacuum contained may be depressurized to vacuum, and then the object may be heated by the heater to a predetermined temperature.

Preferably, the above-mentioned heating furnace is provided with a gas-cooling/circulating unit for heating chamber which cools and circulates a gas passing through an inside of the heating chamber.

Due to this configuration, the cooling gas is circulated by the gas-cooling/circulating unit for heating chamber so that the interior of the vacuum container may be cooled for a short period of time.

Further, in accordance with a further embodiment of the present invention, the above-mentioned heating furnace is further provided with a carrying-in/out door for heating furnace, which is disposed on a side opposite to the side on which the cooling chamber is disposed and is arranged for performing carrying-in of or carrying-out of the object.

Due to this configuration, the object may be directly carried into or out of the heating chamber by means of the carrying-in/out door for heating furnace.

In accordance with the present invention, there is provided a double-chamber type heat-treating furnace which is characterized by comprising a cooling furnace for cooling an object, a heating furnace for heating the object, and a transfer unit for transferring the object between the heating and cooling chambers, the transfer unit, the heating furnace and the cooling furnace being disposed in order.

The above and other objects, features and advantages of the present invention will be made more apparent from the ensuing explanation with reference to the accompanying drawings.

BRIEF DESCRIPTION OF THE DRAWINGS

FIGS. 4A and 4B shall collectively be referred to herein as "FIG. 4."

DESCRIPTION OF THE PREFERRED EMBODIMENTS

Figure 1:
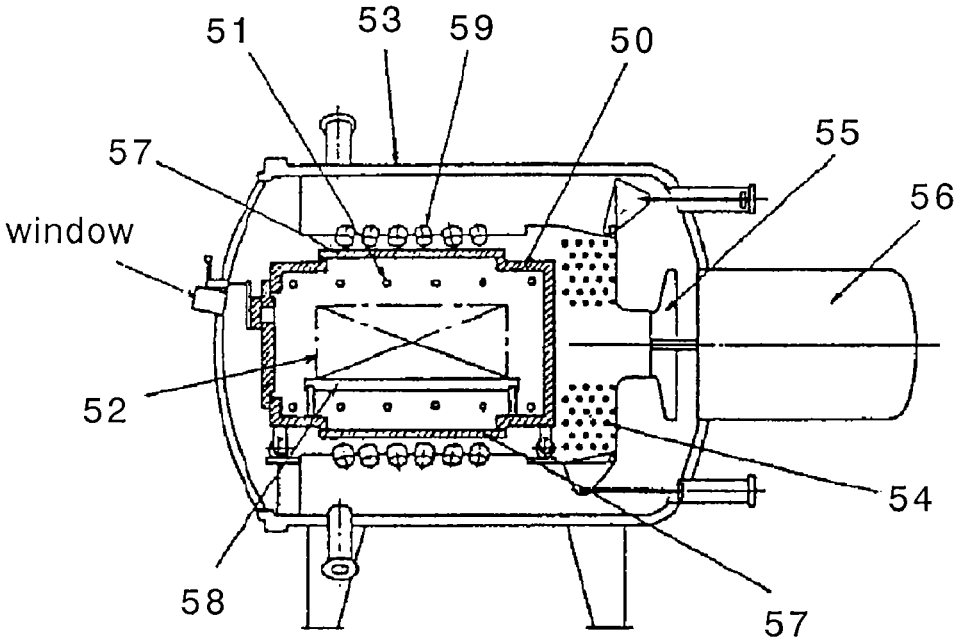
Fig.1 Prior Art
FIG. 1 is a schematic view illustrating a general construction of a high-speed circulating gas-cooling furnace disclosed in the non-patent document 1.
Figure 2:
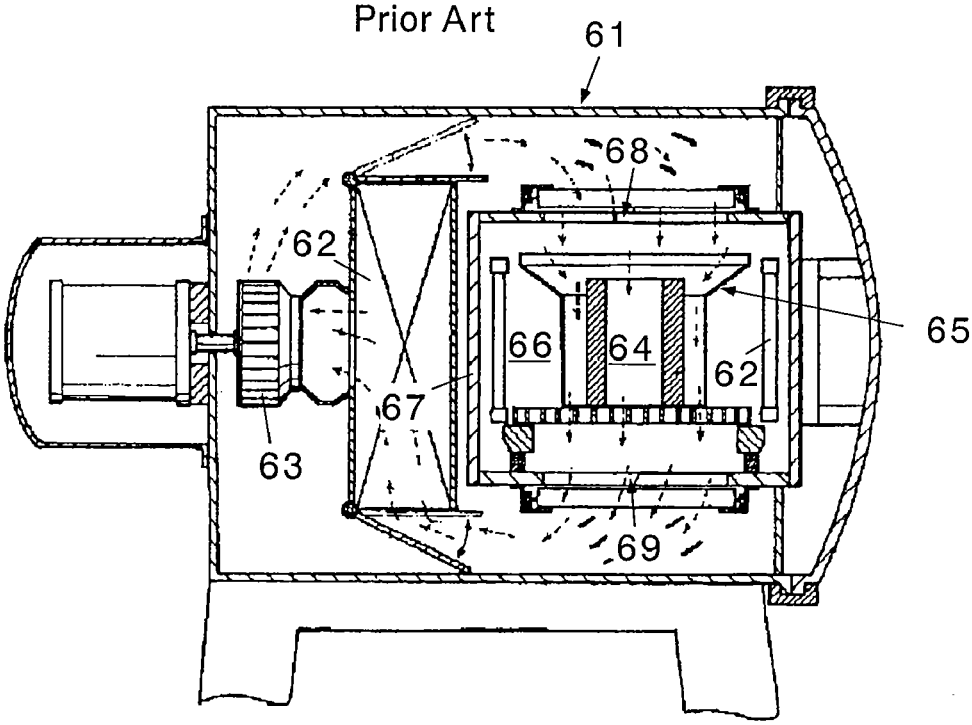
Fig.2 Prior Art
FIG. 2 is a schematic view illustrating a general construction of "a method of promoting gas-circulation/cooling in a vacuum furnace" of the patent document 1.
Figure 3:
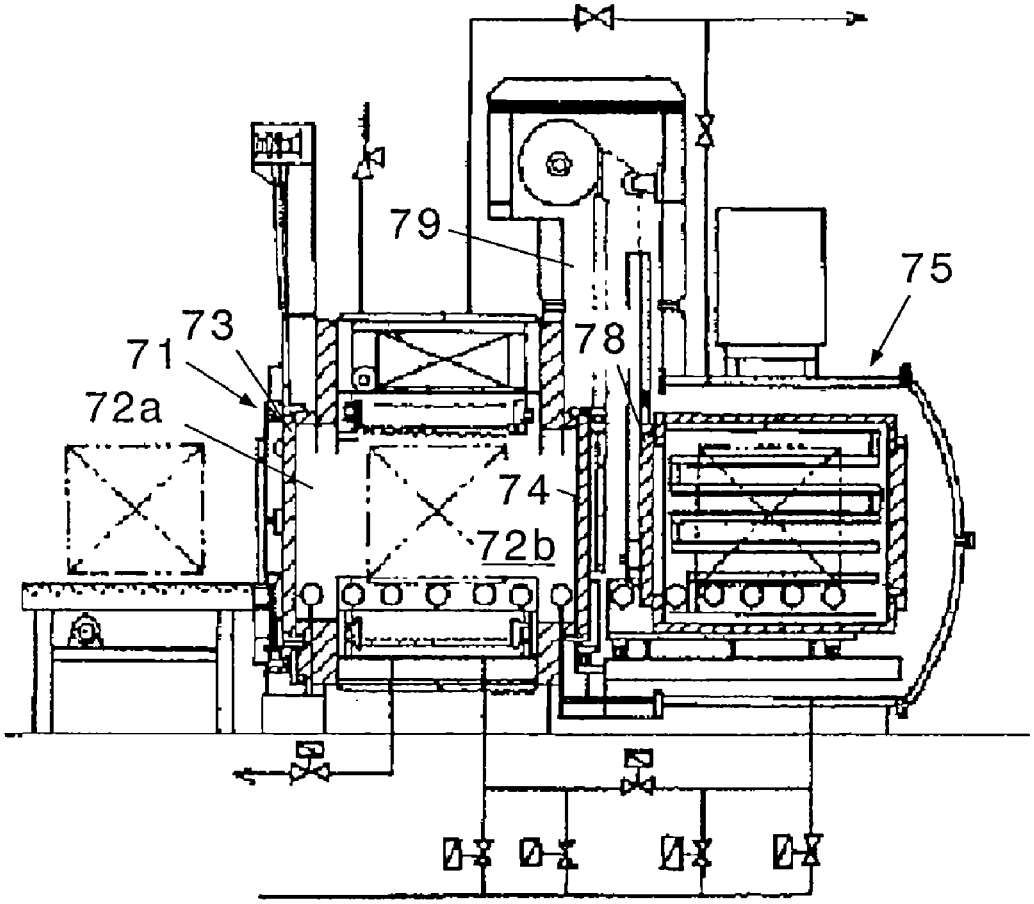
Fig.3 Prior Art
FIG. 3 is a schematic view illustrating "a multi-chamber type heat-treating furnace" of the patent document 2.

Description of the preferred embodiments of the present invention will be provided hereinbelow, with reference to the accompanying drawings. It should be noted that common portions throughout the respective drawings will be designated by the same reference numerals and repetitive description will be omitted.

Figures 4A, 4B:
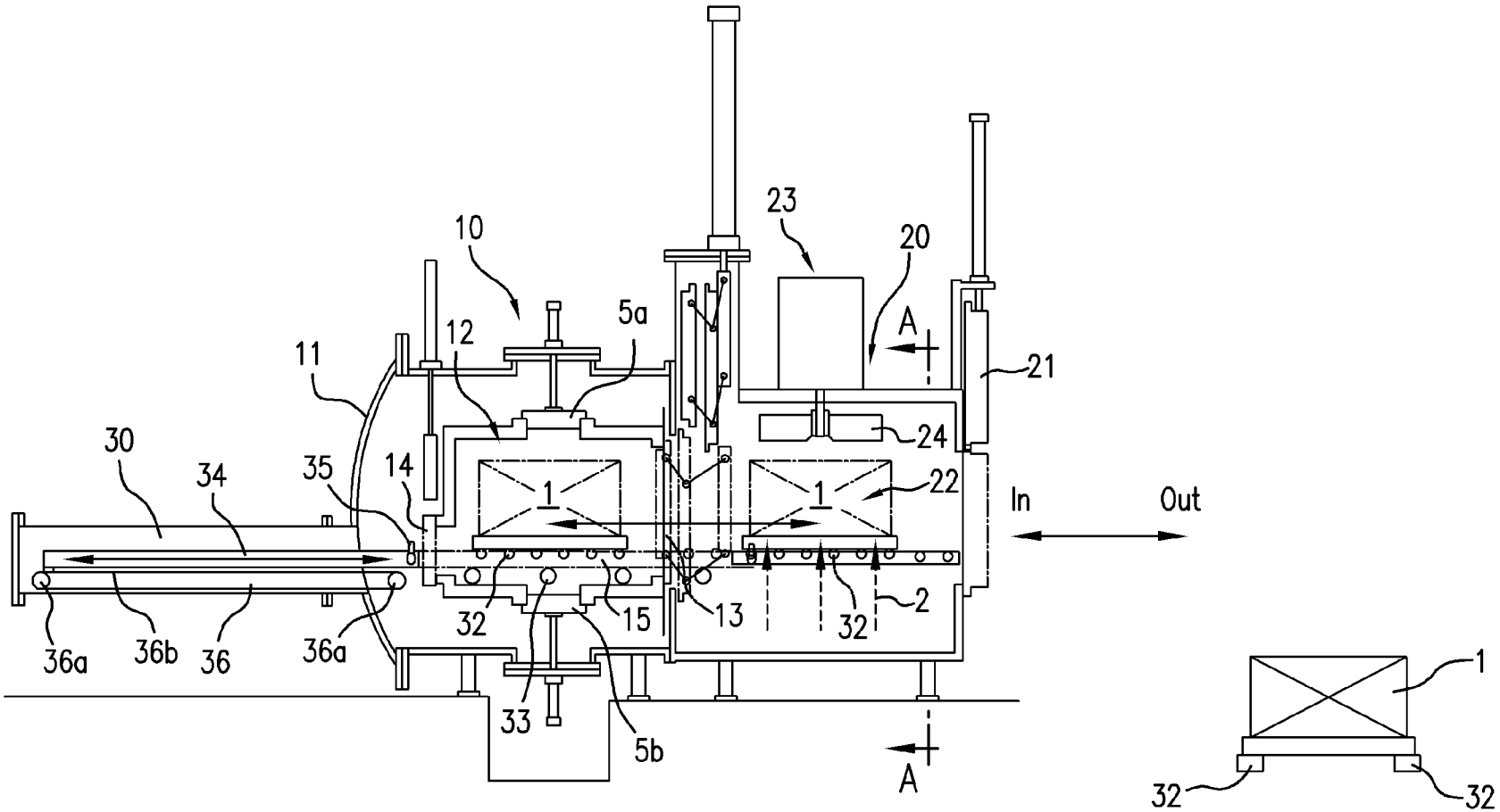
FIG. 4A is a schematic view illustrating a general configuration of a double-chamber type heat-treating furnace according to a first embodiment of the present invention.
FIG. 4B is a side view of element 1 of FIG. 4A.

FIG. 4 is a general constructional view of a double-chamber type heat-treating furnace according to the first embodiment of the present invention. The double-chamber type heat-treating furnace of the present invention is provided with heating furnace 10, cooling furnace 20, and transfer unit 30.

Heating furnace 10 is a hermetically closable furnace incorporating therein a heating chamber 12 which is arranged adjacent to a cooling chamber 22 at a height substantially identical to that of the cooling chamber and is provided for heating the object 1, and has a function to heat the object 1 when inert gas and so on is re-filled therein after depressurizing the interior thereof. Cooling furnace 20 is a hermetically closable pressurizing container incorporating therein cooling chamber 22 for gas-cooling the object 1 after being heated, and has a function to cool the object 1 after being heated, with pressurized circulating gas 2. Transfer unit 30 has a function to transfer the object 1 between heating chamber 12 and cooling chamber 22 in a horizontal state of the object 1.

Heating furnace 10 is comprised of vacuum container 11 of which the interior may be exhausted to become at vacuum, heating chamber 12 receiving therein the object 1, front door 13 for permitting the object 1 to be introduced into and delivered from the heating chamber, rear door 14 which closes an opening through which the object 1 in the heating chamber is moved, mounting bed 15 mounting thereon the object 1 to be horizontally movable back and forth, a heater (not shown) for heating the object 1, and so on. In this drawing, front door 13 and rear door 14 are shown to be held at an opened state thereof, respectively. Further, numerals 5*a* and 5*b* designate a top vang and a bottom vang to be used for opening and closing the top and bottom of the heating chamber, respectively.

According to the above-mentioned configuration, the interior of vacuum container 11 can be depressurized to vacuum level, and then the object 1 can be heated to a predetermined temperature.

In FIG. 4, cooling furnace 20 is provided with carrying-in/out door 21 for cooling chamber, cooling chamber 22, and gas-cooling/circulating unit 23 for cooling chamber.

Carrying-in/out door 21 for cooling chamber is provided on a side (a right side in the drawing) opposite to the side on which heating chamber 12 is arranged, and is used for carrying the object 1 into or out of cooling chamber 22. This carrying-in and carrying-out of the object 1 is carried out by a transfer means (for example, a folk lift device, a crane unit and so on). In this drawing, carrying-in/out door 21 for cooling chamber is shown to be held at an opened state thereof.

Cooling chamber 22 is provided for surrounding a cooling region in which the object 1 is steadily place, and for defining, in its interior, a gas passageway having a vertically constant cross-section.

Gas-cooling/circulating unit 23 for cooling chamber is comprised of cooling fan 24 and a heat-exchanger (not shown), and cools and circulates gas 2 vertically passing through the interior of cooling chamber 22 to thereby evenly cool the object 1 with the cooling gas 2. In a different arrangement from that shown in this drawing, gas-cooling/circulating unit 23 for cooling chamber may be arranged at a side face.

Transfer unit 30 is comprised of a plurality of free rollers 32, push-pull member 34, and drive unit 36.

The plurality of free rollers 32 are mounted in the inside of both heating chamber 12 and cooling chamber 22, respectively, and support only both ends of the object 1 in a direction of width to be movable in a horizontal transferring direction.

Each of these free rollers 32 is comprised of a cylindrical short roller element disposed to be freely rotatable about its center, and is arranged so as to provide substantially no block to the smooth flow of gas within cooling chamber 22. Also, the free rollers exhibit only a function to horizontally movably support the object 1 in the horizontal transferring direction, and therefore, these rollers are configured by simple bearings (for example, journal bearings incorporating therein a relatively large spacing), so as not to lose their function even when they are subjected to heating within heating chamber 12. Thus, the structure of each roller can be simple enough for requiring substantial no measures against heating through implantation of periodic inspection thereof or periodic exchange with a newer element.

Push-pull member 34 moves horizontally while being engaged with the object 1thereby horizontally pushing or pulling the object. In the illustrated embodiment, push-pull member 34 may preferably be a long or slender member so that when a rearmost end thereof (the left-hand end in FIG. 4) comes to a position close to the left, or first, side of heating chamber 12 in the drawing, a frontmost end thereof (the right-hand end in FIG. 4) arrives at a position located inside cooling chamber 22. Also, this push-pull member 34 has, at its frontmost end, an engaging member 35 capable of turning up or lying down, and is configured in a manner such that either the turning-up motion or lying-down motion of the push-pull member 34 may be operated whenever required, by an actuator (not shown) incorporated in the rearmost end of push-pull member 34. Due to the turning-up motion and lying down motion, the engaging member 35 may alternatively come to either a higher position thereof or a lower position thereof at any time. Thus, upon being turned up to the higher position, it can be engaged with the object 1 (or its mounting bed) so as to horizontally push or pull the object 1, and upon being lied down, it can move horizontally without engaging of the engaging member with the object (or its mounting bed).

At this stage, the above-mentioned mechanism for operating turning-up and lying-down motions is not limited to a mechanism for directly causing such motions by means of the actuator, but may employ any other type of alternative mechanism for causing turning-up and lying down motion from the exterior of heating chamber 12 and cooling chamber 22, such as a lack-and pinion mechanism, a chain-drive mechanism and the other like. Further, in order to constantly maintain the horizontal posture of push-pull member 34, free rollers 33 for push-pull member are provided at a region other than cooling chamber 22.

Drive unit 36 is arranged adjacent to a side (the left-hand side in the drawing) of the heating chamber, which side is opposite to the side on which the cooling chamber is located, and has a function to horizontally move push-pull member 34. In this embodiment, drive unit 36 is comprised of an endless chain 36*b* arranged to be wound around and to run over a pair of sprockets 36*a* and a portion of endless chain 36*b* is connected to the rearmost end of push-pull member 34. In addition, sprocket 36*a* on the left-hand side in the drawing is arranged to be rotationally driven by a not-illustrated rotational drive motor.

Due to this configuration, the rotational drive motor rotationally drives sprocket 36*a* to horizontally move the rearmost end of push-pull member 34 thereby be able to entail a horizontal movement of engaging member 35 on the frontmost end of push-pull member 34.

In accordance with the above-described construction of the furnace of FIG. 4, only free rollers 32 constituting transfer unit 30 are arranged within heating chamber 12 and cooling chamber 22, so as to support only both ends of the object 1 in the direction of width thereof and thus, smooth flow of gas within cooling chamber 22 cannot be substantially prevented.

Further, since free rollers 32 have only a function to support the object 1 so as to move it in a horizontal transferring direction, and requires substantially no measures against heating, the structure thereof can be very simple.

Accordingly, since there is no other transferring mechanism other than free rollers 32 within the cooling chamber, the flow of gas is not blocked. Further, since there is no other transferring mechanism other than the free rollers, no complicated means for the transfer of the object is needed.

Furthermore, when engaging member 35 is turned up to its higher position to thereby horizontally move push-pull member 34, it is possible to horizontally push or pull the object 1. In addition, when engaging member 35 is lie down to its lower position, the engaging member can horizontally move push-pull member 34 without being engaged with the object 1. Therefore, after carrying the object 1 into cooling chamber 22 from the exterior, the object can be transferred from cooling chamber 22 into heating chamber 12 by means of transfer unit 30, and after being subjected to heating treatment, the object can be transferred from heating chamber 12 into cooling chamber so that after being subjected to cooling treatment, the object may be delivered from the cooling chamber toward the exterior. Moreover, during heating of the object within the heating chamber and during cooling thereof within the cooling chamber, push-pull member 34 may be retracted to its waiting position on the left side of heating chamber 12 and accordingly, the respective chambers may be constantly maintained at a hermetic state. In addition, during staying in the waiting position, transfer unit 30 other than free rollers 32 comes to a no heating region and therefore, the transfer unit can be prevented from being subjected to any excessive heating without applying any particular measures against heating.

Figure 5:
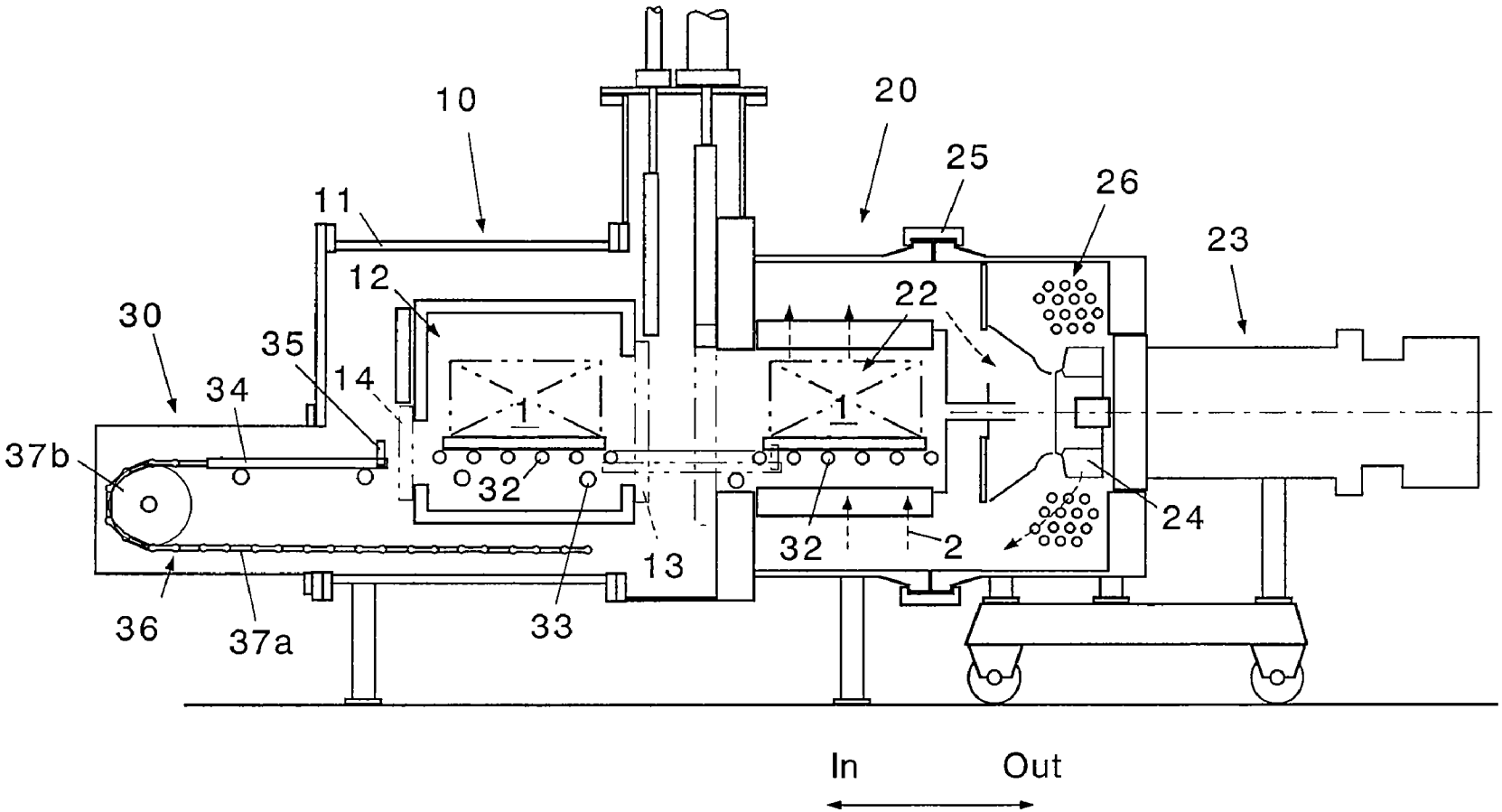
FIG. 5 is a schematic view illustrating a general configuration of a double-chamber type heat-treating furnace according to a second embodiment of the present invention.

FIG. 5 is a general constructional view of a double-chamber type heat-treating furnace according to the second embodiment of the present invention.

In this embodiment, transfer unit 30 is structured in a chain-operated pushes-puller type. Further, drive unit 36 is comprised of a horizontally moving chain 37*a* connected to the rearmost end of push-pull member 34 and carrying out a horizontal movement, sprocket 37*b* engaged with the horizontally moving chain 37*a*, and a rotational drive motor (not shown) which rotationally drives sprocket 37*b*. Further, in order to constantly hold push-pull member 34 and horizontally moving chain 37*a* at a horizontal state, respectively, free rollers 33 for push-pull member are appropriately arranged in a region other than cooling chamber 22.

By virtue of this configuration, sprocket 37*b* can be driven by the rotational drive motor so as to horizontally move horizontally moving chain 37*a* thereby moving push-pull member 34 in a horizontal direction. Thus, it is possible to horizontally move engaging member 35 arranged at the frontmost end of the push-pull member.

Furthermore, in this embodiment, cooling furnace 20 is structured to be divided in a left and right direction by means of hermetically openable and closable clutch ring 25, and incorporates therein gas-cooling/circulating device 24 and heat exchanger 26 at the right end thereof in the drawing.

Due to this configuration, when clutch ring 25 is released, and when gas-cooling/circulating device 24 and heat exchanger 26 are moved back rightward in the drawing, the object 1 can be directly received and settled within cooling chamber 22. Moreover, when cooling furnace 20 is hermetically sealed by clutch ring 25, and when pressurized gas for cooling (argon gas, helium gas, nitrogen gas, hydrogen gas and the like) is supplied into the interior of the cooling furnace, such pressurized gas can be used for cooling purpose.

Cooling chamber 22 is provided at a position adjacent to heating furnace 10 and disposed in the central portion of the container barrel. Cooling chamber 22 is sectioned, on its side adjacent to the heating furnace, by the intermediate heat-insulating door, and the side thereof adjacent to the gas-cooling/circulating device and both side faces thereof are sectioned by hermetic heat-insulating walls. Also, this cooling chamber 22 is opened at its top and bottom ends, and defines, in the inside thereof, a gas passageway having a vertically constant cross-section. The inside of this cooling chamber 22 is provided as a cooling region. Thus, the object 1, which may be, for example, small metallic parts such as rotor blades of a gear/shaft jet-engine, stator blades thereof, bolts and so on, are contained by a tray or a basket so that the object together with the tray or basket are steadily placed in the center of cooling chamber 22 in a state where they are mounted on a porous mounting bed.

Mounting bed 23 is placed at a height the same as that of the mounting bed of heating furnace 10, and is made free to move on rollers 32 incorporated therein. The other structure of the mounting bed is similar to the first embodiment.

Due to this configuration, when engaging member 35 is turned up to its higher position, and when push-pull member 34 is horizontally moved, the object 1 can be horizontally pushed or pulled. When engaging member 35 is lied down to its lower position, the member can horizontally move push-pull member 35 without being engaged with the object 1. Therefore, by releasing clutch ring 25, the object 1 can be carried into cooling chamber 22 from the exterior due to releasing of clutch ring 25, and is then transferred from cooling chamber 22 into heating chamber 12 by the use of transfer unit 30 so as to be subjected to heating-treatment. Thereafter, the object 1 may be transferred from heating chamber 12 to cooling chamber 22 to be cooled there. After cooling, the object can be carried out of the cooling chamber to the exterior. Moreover, during heating in the cooling chamber and during cooling in the cooling chamber, push-pull member 34 can be moved back toward its waiting position located on the left side of heating chamber 12 and therefore, respective chambers 12 and 22 can be maintained at a hermetically sealed state. In addition, during staying in the waiting position, transfer unit 30 except for its free rollers 32 is positioned at a non-heating region. Thus, any excessive heating of the unit can be prevented without employment of any particular measures against heating.

Figure 6:
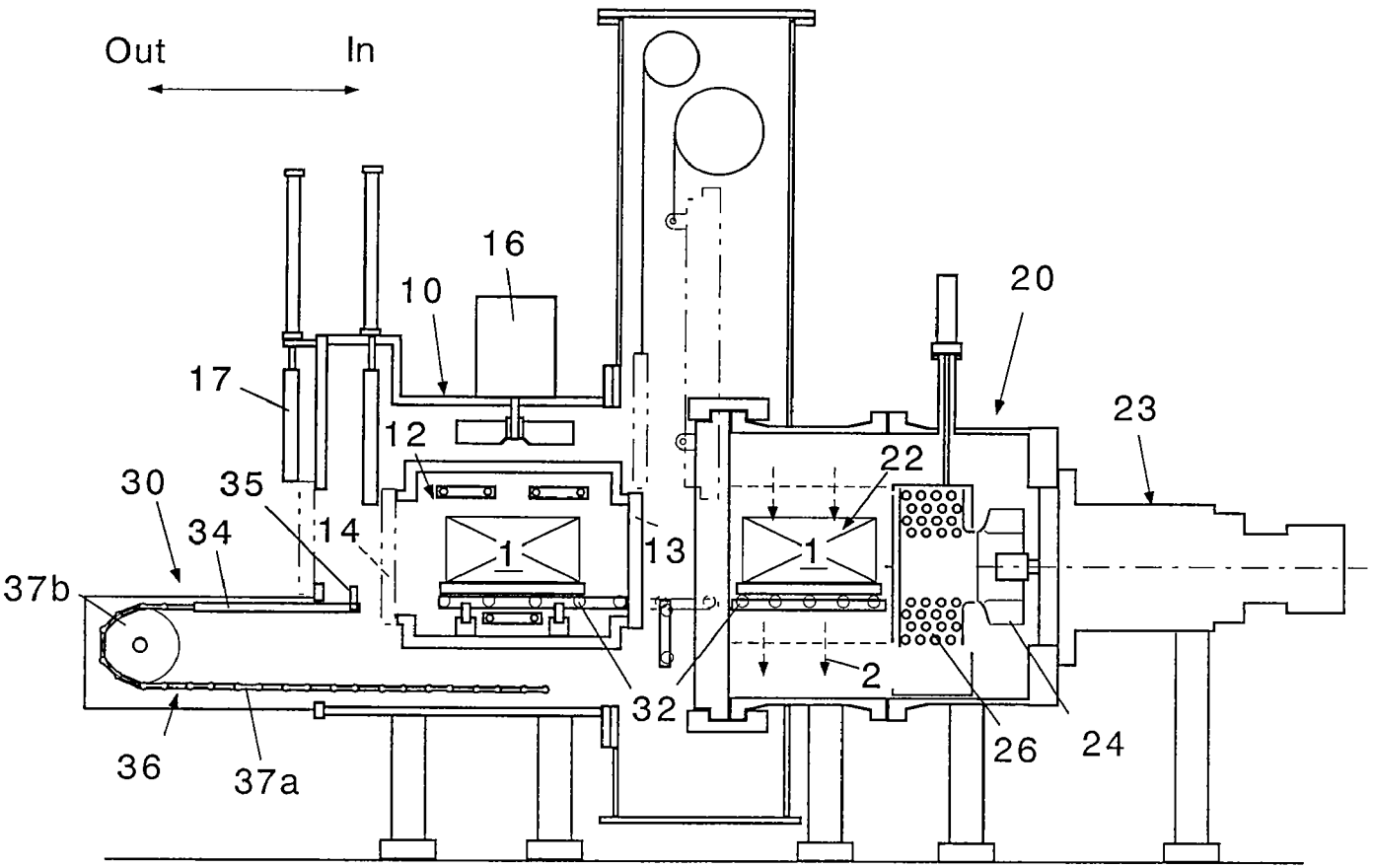
FIG. 6 is a schematic view illustrating a general configuration of a double-chamber type heat-treating furnace according to a third embodiment of the present invention.

FIG. 6 is a general constructional view of a double-chamber heat-treating furnace according to the third embodiment of the present invention.

In this embodiment, heating furnace 10 is provided with gas-cooling/circulating device 16 for heating chamber, which cools and circulates a gas passing through the interior of heating chamber 12. Heating furnace 10 is further provided with carrying-in/out door 17 for heating furnace on the side (the left side in the drawing) opposite to the side on which cooling chamber 22 is disposed, so that the object 1 may be directly carried into or out of heating chamber 12. The other structure of this double-chamber heat-treating furnace is similar to that of the second embodiment.

Due to this configuration, when engaging member 35 is brought to its higher position, and when push-pull member 34 is horizontally moved, the object 1 can be pushed or pulled. While when engaging member 35 is brought to its lower position, push-pull member 34 can be horizontally moved without engaging of engaging member 35 with the object 1. Therefore, when carrying-in/out door 17 for heating furnace is opened so as to carry the object 1 into heating chamber 12 from the exterior, the object 1 can be subjected to heating treatment there, and thereafter, the object 1 after being heat-treated can be transferred from heating chamber 12 to cooling chamber 22. Then, after being cooled there, the object 1 can be carried out of cooling chamber 22 to the exterior. Moreover, during heating within the heating chamber and during cooling within the cooling chamber, push-pull member 34 may be moved back toward its waiting position located on the left side of heating chamber 12 and accordingly, respective chambers, i.e., the heating chamber and the cooling chamber may be kept at a hermetically sealed condition. In addition, during the stay in the waiting position, transfer unit 30 except for free rollers is placed in the non-heating region and therefore, the transfer unit can be prevented from being exposed to any excessive heat without any particular measures against the heating.

Although the present invention is described on the basis of several preferred embodiments and examples thereof, but it should be understood that the present invention is not limited to the described embodiments and examples, and many modifications and changes will occur to a person having ordinary skill in the art without departing from the scope and spirit of the present invention as claimed in the appended claims.

The invention claimed is:

1. A double-chamber type heat-treating furnace comprising:

(a) a hermetically closable cooling furnace incorporating therein a cooling chamber and arranged for cooling an object after being subjected to heating;

(b) a hermetically closable heating furnace incorporating therein a heating chamber disposed at a position adjacent to the cooling chamber and arranged for heating the object; and (c) a transfer unit arranged for transferring the object between the heating chamber and the cooling chamber, wherein the transfer unit comprises i. a plurality of free rollers disposed within the heating and cooling chambers, respectively, and for supporting the object at only both ends of the object in a direction of width thereof to be movable in a transferring direction;

ii. a push-pull member capable of moving while being engaged with the object thereby pushing or pulling the object between the heating and cooling chambers, wherein the push-pull member is of a length such that when a rearmost end of the push-pull member comes to a position close to a first side of the heating chamber, a frontmost end of the push-pull member arrives at a position located inside the cooling chamber; and iii. a drive unit arranged at a position adjacent to the heating chamber on a side opposite to a side on which the cooling chamber is disposed and capable of driving the push-pull device.

2. The double-chamber type heat-treating furnace according to claim 1, wherein the push-pull member comprises an engaging member capable of turning up to a higher position thereof where the engaging member is engaged with the object to horizontally push and pull the object, and lying down to a lower position thereof where the engaging member moves horizontally without being engaged with the object.

3. The double-chamber type heat-treating furnace according to claim 2, wherein the drive unit comprises (1) a horizontally movable chain connected to a rearmost end of the push-pull member and being capable of horizontally moving;

(2) a sprocket engaged with the horizontally movable chain; and (3) a rotational motor that rotationally drives the sprocket.

4. The double-chamber type heat-treating furnace according to claim 1, wherein the cooling furnace comprises i. a carrying-in/out door for the cooling chamber, wherein the carrying-in/out door is arranged on a side opposite to the side on which the heating chamber is provided and is arranged for carrying the object into and out of the cooling chamber; and ii. a gas-cooling/circulating unit for the cooling chamber, wherein the gas-cooling/circulating unit cools and circulates a gas vertically passing through an inside of the cooling chamber; and the cooling chamber is provided for surrounding a cooling region in which the object is permitted to be placed and an inside of the cooling chamber defines a gas passageway with a constant cross-section in a vertical direction.

5. The double-chamber type heat-treating furnace according to claim 1, wherein the heating furnace comprises i. a vacuum container of which an interior is exhausted to at vacuum;

ii. a heating chamber capable of receiving therein the object;

iii. a front door for introducing and delivering the object into and from the heating chamber;

iv. a rear door for closing an opening provided for permitting, therethrough, the object within the heating chamber to be moved;

v. a mounting bed for mounting thereon the object to be horizontally movable back and forth; and vi. a heater arranged for heating the object.

6. The double-chamber type heat-treating furnace according to claim 5, wherein the heating furnace further comprises a gas-cooling/circulating device for the heating chamber, wherein the gas-cooling/circulating device cools and circulates a gas passing through an inside of the heating chamber.

7. The double-chamber type heat-treating furnace according to claim 5, wherein the heating furnace further comprises a carrying-in/out door for the heating furnace, wherein the carrying-in/out door is disposed on a side opposite to the side on which the cooling chamber is disposed and is arranged for performing carrying-in of or carrying-out of the object.

8. The double-chamber type heat-treating furnace according to claim 1, wherein the transfer unit, the heating furnace and the cooling furnace are arranged in order.

* * * * *